United States Patent [19]

Shinjo

[11] Patent Number: 4,881,395

[45] Date of Patent: Nov. 21, 1989

[54] PROCESS AND APPARATUS FOR FABRICATING STEPPED NAILS

[75] Inventor: Katsumi Shinjo, Osaka, Japan

[73] Assignees: Yugen Kaisha Shinjo Seisakusho; Teruyuki Matsui; Kikuma Matsuyama; Toshisaida Saito, all of Osaka, Japan

[21] Appl. No.: 209,380

[22] Filed: Jun. 21, 1988

[51] Int. Cl.[4] ..... B21H 3/06; B21H 3/30

[52] U.S. Cl. ..... 72/90; 10/53; 10/54

[58] Field of Search ..... 10/4, 9, 10 R, 21, 24, 10/27 R, 31, 34, 35, 42, 53, 54; 72/88, 90, 374, 375, 377

[56] References Cited

U.S. PATENT DOCUMENTS

| | | | |
|---|---|---|---|
| 1,913,143 | 6/1933 | Robertson | 72/90 |
| 4,147,088 | 4/1979 | Whittaker | 10/10 R X |
| 4,722,107 | 2/1988 | Kariya | 10/4 |

*Primary Examiner*—E. Michael Combs

*Attorney, Agent, or Firm*—Antonelli, Terry & Wands

[57] ABSTRACT

A process and die unit for fabricating stepped nails wherein a top portion of a blank is pressed into a rough slender tip portion at the first step of the process, and a shank portion of the blank is pressed in the second step of process so as to have threads on the peripheral surface thereof, and the rough slender tip portion is simultaneously pressed for correction so as to refine into a finished slender tip portion.

4 Claims, 4 Drawing Sheets

PROCESS AND APPARATUS FOR FABRICATING STEPPED NAILS

BACKGROUND OF THE INVENTION

The present invention relates to a process and die unit for fabricating stepped nails, wherein the stepped nails are designed for use in holding separate wooden pieces together.

To fasten wooden pieces together, nails are commonly used. However, the problem encountered is that a driven nail often causes a crack in the pieces, with the crack being due to the fact that the pointed portion of the nail radially wedges into the wooden pieces against the shearing strength thereof.

There have been a number of proposals to prevent wooden pieces from cracking when fastened together by nails, with such proposals including, for example, providing a nail having a slender tip portion with a diameter smaller than a diameter of a shank portion whereby the tip portion is clearly distinct from the shank portion by a shoulder.

Nails of this type are fabricated by cutting or pressing, but the cutting process is expensive, and is not suitable for mass production. The pressing involves a technical difficulty in forming a straight shoulder perpendicular to the axis of the shank portion, which is essential for nails to anchor in the wooden pieces.

An object of the present invention is to provide a process and a die unit which solve the problems pointed out above. Thus, an object of the present invention is to provide a process and a die unit for fabricating stepped nails easily and ecnomonically.

According to one advantageous aspect of the present invention, there is provided a process for fabricating stepped nails, with the process comprising pressing a top portion of a blank by a first die unit to shape the same into a rough slender tip portion, with the slender tip portion having a smaller diameter than the diameter of a shank portion of the blank, pressing the shank portion of the blank by a thread rolling die section of a second die unit so as to cut threads on the peripheral surface thereof, and simultaneously pressing the rough slender tip portion by a correction die section of the second die unit to refine the same into a finished slender tip portion.

According to another advantageous aspect of the present invention, there is provided a die unit for fabricating stepped nails, wherein the unit comprises a first die unit for pressing a top portion of a blank to shape the same into a rough slender tip portion, and a second die unit including a thread rolling die section for pressing a shank portion of the blank to cut threads on the peripheral surface thereof, and a correction die section for finishing the rough slender tip portion into a refined state.

Other objects and advantages of the present invention will become more apparent from the following detailed description, when taken in connection with the accompanying drawings which show, for the purposes of illustration only, one embodiment in accordance with the present invention.

DETAILED DESCRIPTION OF THE INVENTION

Figure 9:
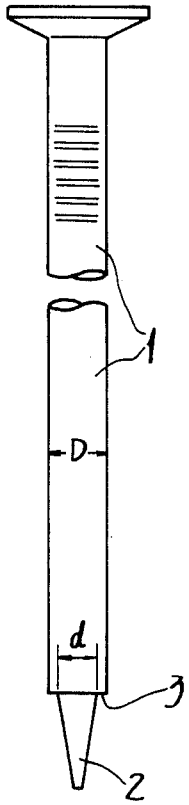
FIG. 9 is a front view showing a prior art stepped nail.

Referring now to the drawings wherein like reference numerals are used throughout the various views to designate like parts and, more particularly, to FIG. 9, according to this figure, a prior art nail includes a shank portion 1 having a diameter D and a tip portion 2 having a diameter d which is smaller than the diameter D of the shank portion 1 resulting in the formation of a shoulder 3. As indicated hereinabove, a nail of this type is not suitable for mass production for a number of reasons outlined above.

Figure 1:
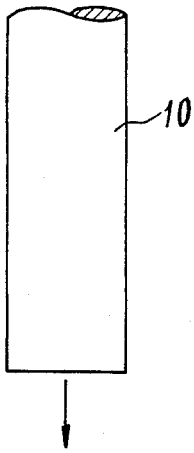
FIGS. 1*a*, 1*b* and 1*c* are planned views illustrating a first step of process according to the present invention.
Figure 1:
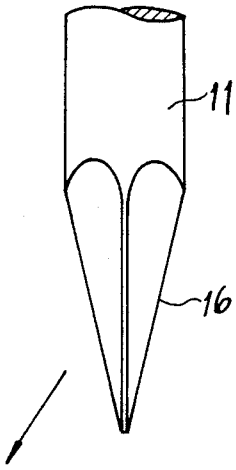
Figure 2:
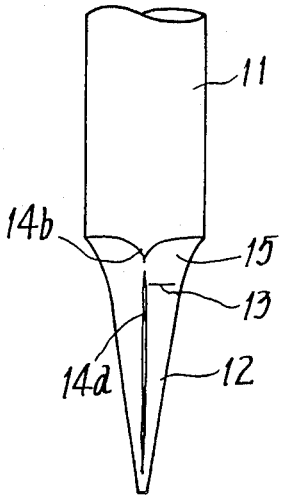
FIG. 2 is a side view showing a rough stepped nail processed in the first step.
Figure 1:
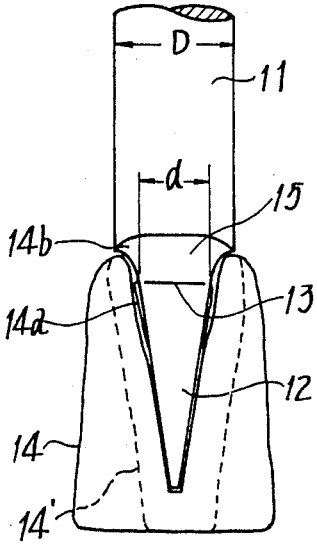
Figure 3:
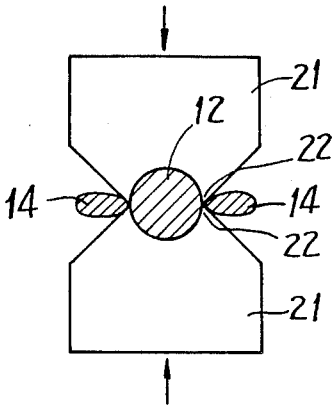
FIG. 3 is a plan view showing a first die unit used for performing the process according to the present invention.
Figure 8:
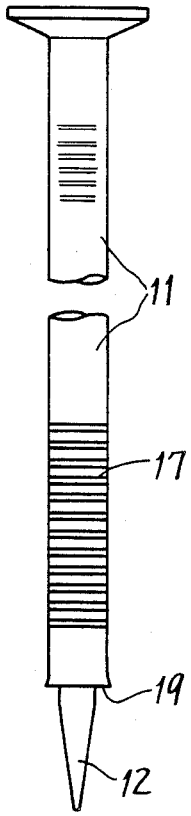
FIG. 8 is a front view showing a finished stepped nail of the present invention.

In accordance with the method of the present invention, as shown in FIGS. 1(*a*)-1(*b*), 2 and 3, which a blank 10 is worked to have a rough slender tip portion 12. FIG. 1*a* shows a blank 10 obtained by cutting a cylindrical material to a desired length, and providing each of the cut pieces with a nail head (not shown). Alternatively, ready-made nails can be used (FIG. 1*c*). Regardless of the manner in which the blank 10 is prepared, as shown in FIG. 3, the blank 10 is the pressed by and between a pair of dies 21 so as to have a slender tip portion 12 whose base portion 13 (FIG. 1(*b*) has a smaller diameter d than the diameter D of a shank portion 11. At this stage the tip portion 12 is in a rough state, which is refined at a later stage into a finished nail shown in FIG. 8. The diameter d is preferably $0.60\times(D)$. When the blank 10 is pressed by the dies 21, a scrap 14 is unavoidably produced as shown in FIGS. 1(*b*) and 3, and the blank 10 tends to elongate in an upward direction. Under the tendency of elongation a round shoulder 15 is formed in an area between the base portion 13 and the shank 11. The scrap 14 is cut away by the die edges 22, with the leftovers of flashes 14*a*, 14*b* around the tip portion 12 and the round shoulder 15. The flashes 14*a*, 14*b* are removed at a later refining stage. When the ready-made nail shown in FIG. 1*c* is used, its pointed end portion 16 is pressed by and between the dies 21 in the same manner above. In this case a smaller amount of the scrap 14 is produced as indicated by dotted lines 14' in FIG. 1*b*.

Figure 4:
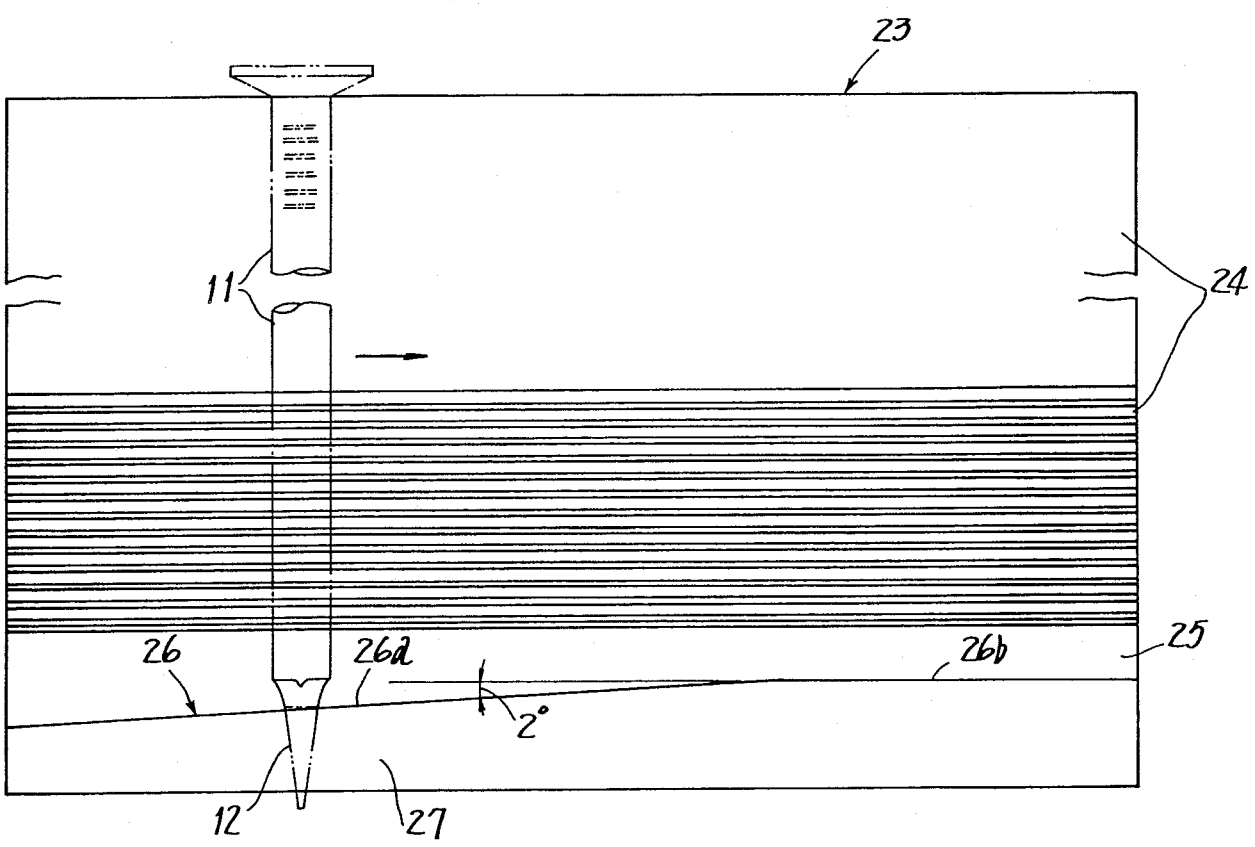
FIG. 4 is a front view showing a second die unit for refining the rough stepped nail of FIG. 2.
Figure 7:
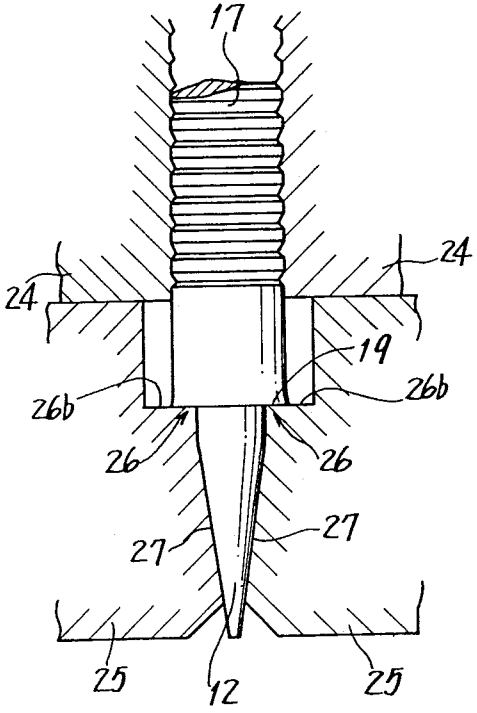
FIGS. 5 to 7 are cross-sectional views illustrating a second step of the process according to the present invention.
Figure 6:
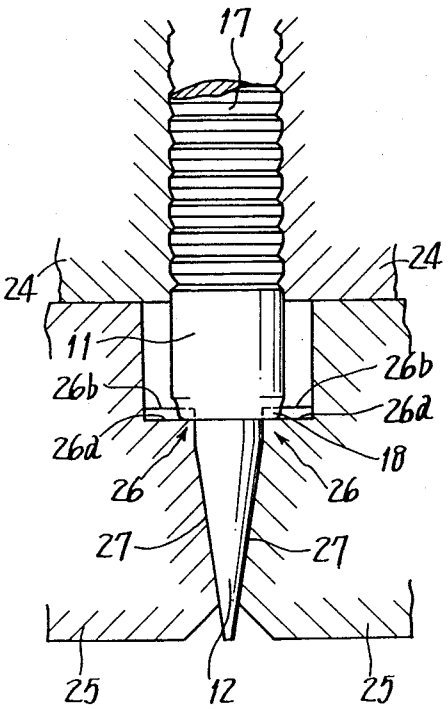
Figure 5:
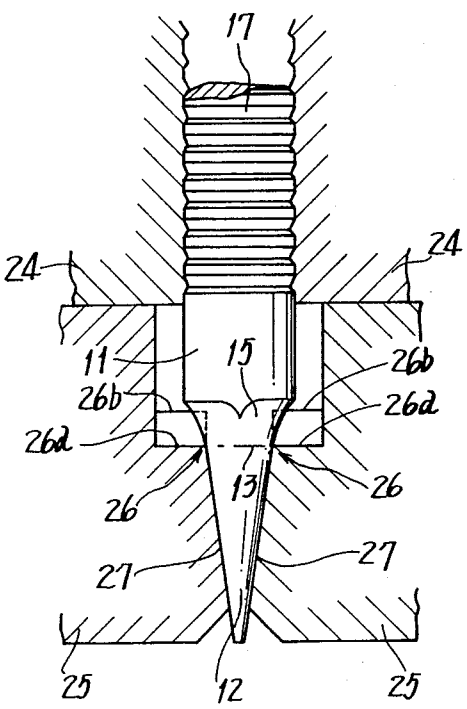

As shown in FIG. 4, the die unit 23 is designed to finish the blank 10 processed in the first step, and includes a thread rolling die section 24 and a correction die section 25 as shown in FIGS. 5 to 7. Each section includes a pair of dies adapted to press the blank 10 therebetween. The thread rolling die section 24 is designed to cut threads 17 on the peripheral surface of the shank 11. The threads 17 have ridges and grooves alternately produced, wherein the grooves have divergently tapered side walls so that the threads prevent the blank 10 from coming out of the dies under a possible upward urge from below. The correction die section 25, which is designed to refine the round shoulder 15 into a sharply defined shoulder 19, includes a correction shoulder 26 and a surface 27 curved so as to be complement with the outer profile of the tip portion 12. The correction shoulder 26 includes a rising portion 26*a*, preferably at an angle of about 2°, and a flat portion 26*b*. One of the die members is stationary, and the other is reciprocably movable.

Referring to FIG. 5, the blank 10 is positioned such that the base portion 13 thereof is flush with the correction shoulder 26 of the correction die section 25 or at a slightly lower position than the correction shoulder 26. The blank 10 is caused to roll by the thread rolling die section 24, and while the blank 10 rolls, the threads 17 are cut on the peripheral surface of the shank 11. The newly cut threads 17 engage with the threads on the rolling die section 24, thereby preventing the blank 10 from coming out of the die unit 23. While the blank 10 rolls, the round shoulder 15 is gradually squeezed by the rising portion 26*a* of the correction shoulder 26, with the squeezed metal 18 protruding radially. As the blank 10 continues to roll, the slender tip portion 12 of the blank 10 reaches the flat portion 26*b* of the correction shoulder 26, where the squeezing of the shoulder 15 comes to an end. The squeezed metal 18 radially protrudes until it has a diameter equal to the diameter D of the shank 11 as shown in FIG. 7. In this manner the rough slender tip portion 12 is refined into a sharply defined shoulder 19 shown in FIG. 8, which is perpendicular to the axis of the shank 11. Any excessive protuberance of the squeezed metal 18 is removed in a known manner.

What is claimed is:

1. A process for fabricating stepped nails, the process comprising the steps of pressing an end portion of a blank by a first die means for shaping the same into a rough slender tip portion having a smaller diameter than a diameter of a shank portion of the blank, pressing the shank portion of the blank by a thread rolling die means of a second die means for cutting threads on a peripheral surface of the shank portion to prevent the blank from coming out of the first die means, providing a correction die means having a shoulder with a rising portion and a curved surface complimentary with an outer profile of the slender tip portion, and squeezing a round shoulder formed between the shank portion and the slender tip portion by the rising portion of the shoulder of the correction die means so as to cause squeezed metal to protrude radially until it has a diameter of the shank portion, thereby forming a shoulder perpendicular to an axis of the shank portion.

2. A process as set forth in claim 1, wherein the blanks are ready-made nails.

3. A process as set forth in claim 1, wherein the threads comprise ridges and grooves alternately formed, wherein the grooves have divergently tapered side walls whereby the threads prevent the blank from coming out of the thread rolling section of the second die unit under upward urge from below.

4. A die unit for fabricating stepped nails, the die unit comprising a first die means for pressing an end portion of a blank to form a rough slender tip portion having a smaller diameter than a diameter of a shank portion of the blank, a second die means including a thread rolling die means for cutting threads on a peripheral surface of the shank portion so as to prevent the blank from coming out of the first die means, and a correction die means, wherein the correction die means has a shoulder and a curved surface complimentary with the outer profile of the slender tip portion, the shoulder of the correction die section comprising a rising portion for squeezing a round shoulder formed between the shank portion and the slender tip portion, thereby causing squeezed metal to protrude radially until it has a diameter of the shank portion, and to form a shoulder perpendicular to the axis of the shank portion.

* * * * *